US006915636B2

(12) United States Patent
Stuttaford et al.

(10) Patent No.: US 6,915,636 B2
(45) **Date of Patent: *Jul. 12, 2005**

(54) DUAL FUEL FIN MIXER SECONDARY FUEL NOZZLE

(75) Inventors: Peter Stuttaford, Jupiter, FL (US); Stephen T. Jennings, Palm City, FL (US); Ryan McMahon, North Palm Beach, FL (US); Hany Rizkalla, Stuart, FL (US); Alfredo Cires, Palm Beach Gardens, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/465,096

(22) Filed: Jun. 19, 2003

(65) Prior Publication Data

US 2004/0006993 A1 Jan. 15, 2004

Related U.S. Application Data

(63) Continuation-in-part of application No. 10/195,823, filed on Jul. 15, 2002, now Pat. No. 6,722,132.

(51) Int. Cl.[7] ..... F02C 1/00; F02G 3/00

(52) U.S. Cl. ..... 60/737; 60/39.463; 60/740

(58) Field of Search ..... 60/737, 733, 738, 60/740, 742, 746, 735, 743, 39.463

(56) References Cited

U.S. PATENT DOCUMENTS 4,292,801 A * 10/1981 Wilkes et al. ..... 60/776
4,982,570 A * 1/1991 Waslo et al. ..... 60/733
5,127,221 A * 7/1992 Beebe ..... 60/772
5,199,265 A 4/1993 Borkowicz
5,408,830 A * 4/1995 Lovett ..... 60/737
5,435,126 A * 7/1995 Beaudoin ..... 60/39.463
5,491,970 A * 2/1996 Davis et al. ..... 60/776
5,685,139 A * 11/1997 Mick et al. ..... 60/776
6,282,904 B1 9/2001 Kraft et al.
6,446,439 B1 9/2002 Kraft et al.
6,467,272 B1 * 10/2002 Biondo et al. ..... 60/740
6,598,383 B1 * 7/2003 Vandervort et al. ..... 60/773
6,675,581 B1 * 1/2004 Stuttaford et al. ..... 60/737
6,691,516 B2 * 2/2004 Stuttaford et al. ..... 60/737
6,722,132 B2 * 4/2004 Stuttaford et al. ..... 60/737
2004/0006989 A1 * 1/2004 Stuttaford et al. ..... 60/776
2004/0006992 A1 * 1/2004 Stuttaford et al. ..... 60/776

OTHER PUBLICATIONS

U.S. Appl. No. 10/195,615, Stuttaford et al.

* cited by examiner

*Primary Examiner*—Cheryl Tyler
*Assistant Examiner*—William H. Rodriguez
(74) *Attorney, Agent, or Firm*—Brian R. Mack

(57) ABSTRACT

A dual fuel premix nozzle and method of operation for use in a gas turbine combustor is disclosed. The dual fuel premix nozzle utilizes a fin assembly comprising a plurality of radially extending fins for injection of gas fuel and compressed air in order to provide a more uniform injection pattern and homogeneous mixture. The premix fuel nozzle includes a plurality of coaxial passages, which provide gaseous fuel and compressed air to the fin assembly. When in liquid fuel operation, the gas circuits are purged with compressed air and liquid fuel and water pass through coaxial passages to the tip of the dual fuel premix fuel nozzle, where they inject liquid fuel and water into the secondary combustion chamber. An alternate embodiment includes an additional gas fuel injection region located along a conically tapered portion of the premixed fuel nozzle, downstream of the fin assembly. A second alternate embodiment is disclosed which reconfigures the injector assembly and fuel injection locations to minimize flow blockage issues at the injector assembly and simplify fuel nozzle manufacturing.

9 Claims, 13 Drawing Sheets

DUAL FUEL FIN MIXER SECONDARY FUEL NOZZLE

This is a continuation-in-part of application Ser. No. 10/195,823 filed Jul. 15, 2002, now U.S. Pat. No. 6,722,132.

BACKGROUND OF THE INVENTION

1. Field of the Invention

This invention relates generally to a fuel and air injection apparatus and method of operation for use in a gas turbine combustor for power generation and more specifically to a device that reduces the emissions of nitrogen oxide (NOx) and other pollutants by injecting gaseous fuel into a combustor in a premix condition while including liquid fuel capability.

2. Description of Related Art

In an effort to reduce the amount of pollution emissions from gas-powered turbines, governmental agencies have enacted numerous regulations requiring reductions in the amount of emissions, especially nitrogen oxide (NOx) and carbon monoxide (CO). Lower combustion emissions can be attributed to a more efficient combustion process, with specific regard to fuel injectors and nozzles. Early combustion systems utilized diffusion type nozzles that produce a diffusion flame, which is a nozzle that injects fuel and air separately and mixing occurs by diffusion in the flame zone. Diffusion type nozzles produce high emissions due to the fact that the fuel and air burn stoichiometrically at high temperature. An improvement over diffusion nozzles is the utilization of some form of premixing such that the fuel and air mix prior to combustion to form a homogeneous mixture that bums at a lower temperature than a diffusion type flame and produces lower NOx emissions. Premixing can occur either internal to the fuel nozzle or external thereto, as long as it is upstream of the combustion zone. Some examples of prior art found in combustion systems that utilize some form of premixing are shown in FIGS. 1 and 2.

Referring to FIG. 1, a fuel nozzle 10 of the prior art for injecting fuel and air is shown. This fuel nozzle includes a diffusion pilot tube 11 and a plurality of discrete pegs 12, which are fed fuel from conduit 13. Diffusion pilot tube 11 injects fuel at the nozzle tip directly into the combustion chamber through swirler 14 to form a stable pilot flame. Though this pilot flame is stable, it is extremely fuel rich and upon combustion with compressed air, this pilot flame is high in nitrogen oxide (NOx) emissions.

Another example of prior art fuel nozzle technology is the fuel nozzle 20 shown in FIG. 2, which includes a separate, annular manifold ring 21 and a diffusion pilot tube 22. Fuel flows to the annular manifold ring 21 and diffusion pilot tube 22 from conduit 23. Diffusion pilot tube 22 injects fuel at the nozzle tip directly into the combustion chamber through swirler 24. Annular manifold ring 21 provides an improvement over the fuel nozzle of FIG. 1 by providing an improved fuel injection pattern and mixing via the annular manifold instead of through radial pegs. The fuel nozzle shown in FIG. 2 is described further in U.S. Pat. No. 6,282,904, assigned to the same assignee as the present invention. Though this fuel nozzle attempts to reduce pollutant emissions over the prior art, by providing an annular manifold to improve fuel and air mixing, further improvements are necessary regarding a significant source of emissions, the diffusion pilot tube 22. The present invention seeks to overcome the shortfalls of the fuel nozzles described above by providing a fuel nozzle that is completely premixed in the gas circuit, thus eliminating all sources of high NOx emissions, while providing the option for dual fuel operation through the addition of liquid fuel and water passages.

SUMMARY AND OBJECTS OF THE INVENTION

It is an object of the present invention to provide a fuel nozzle for a gas turbine engine that reduces NOx and other air pollutants during gas operation.

It is another object of the present invention to provide a premixed fuel nozzle with an injector assembly comprising a plurality of radially extending fins to inject fuel and air into the combustor such that the fuel and air premixes, resulting in a more uniform injection profile for improved combustor performance.

It is yet another object of the present invention to provide, through fuel hole placement, an enriched fuel air shear layer to enhance combustor lean blowout margin in the downstream flame zone.

It is yet another object of the present invention to provide a fuel nozzle for a gas turbine engine that is premixed when operating on gaseous fuel and has the additional capability of operating on liquid fuel.

It is yet another object of the present invention to provide a premixed fuel nozzle with improved combustion stability through the use of a plurality of fuel injection orifices located along a conical surface of the premixed fuel nozzle.

It is yet another object of the present invention to provide an alternate embodiment of the present invention comprising a plurality of radially extending fins to inject fuel only, wherein the nozzle body is configured to reduce blockage between adjacent fins and has the additional capability of operating on liquid fuel.

In accordance with these and other objects, which will become apparent hereinafter, the instant invention will now be described with particular reference to the accompanying drawings.

DETAILED DESCRIPTION OF THE PREFERRED EMBODIMENT

Figure 1:
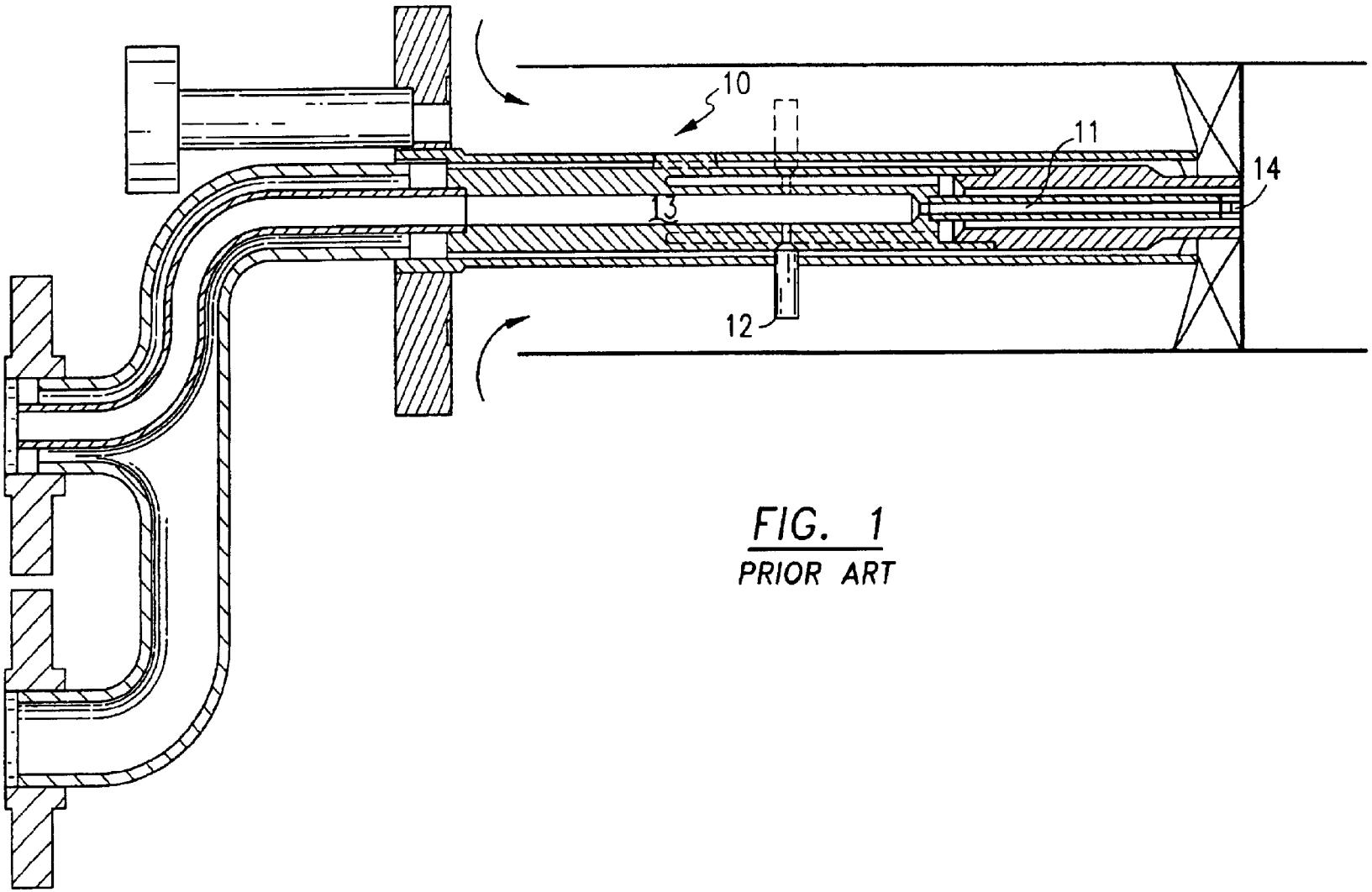
FIG. 1 PRIOR ART
FIG. 1 is a cross section view of a fuel injection nozzle of the prior art.
Figure 2:
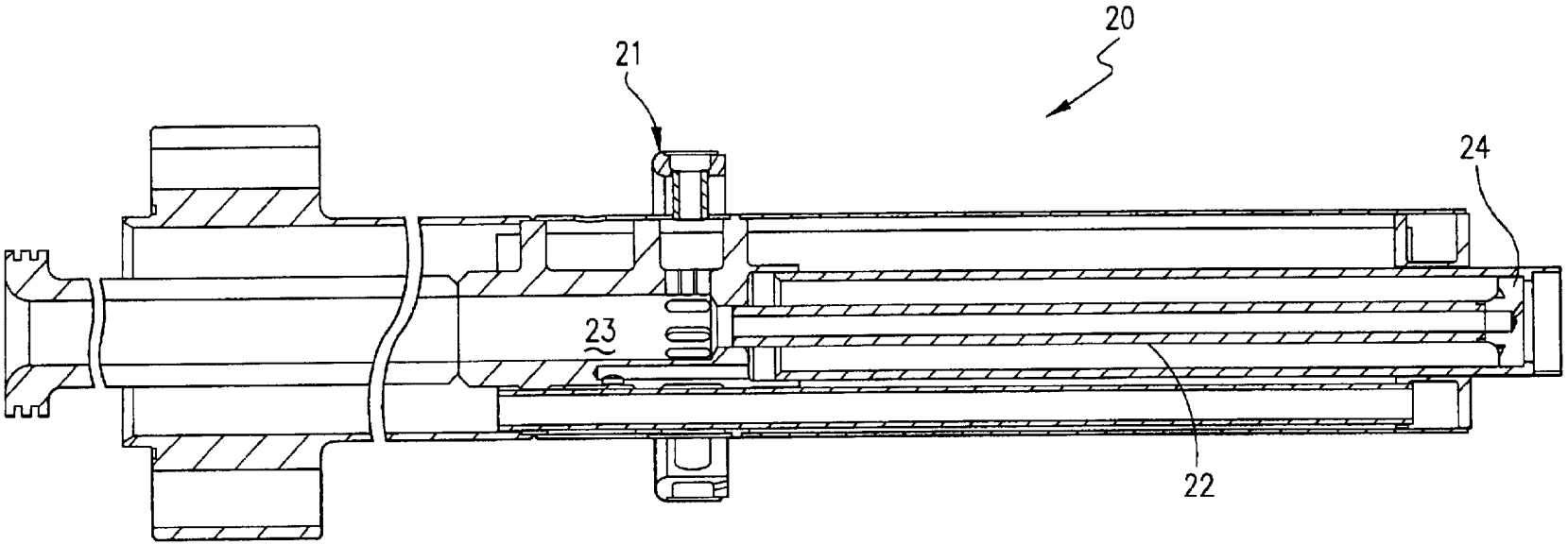
FIG. 2 PRIOR ART
FIG. 2 is a cross section view of a fuel injection nozzle of the prior art.

A dual fuel premix nozzle 40 is shown in detail in FIGS. 3 through 6. Dual fuel premix nozzle 40 has a base 41 with three through holes 42 for bolting premix fuel nozzle 40 to a housing 75 (see FIG. 7). Extending from base 41 is a first tube 43 having a first outer diameter, a first inner diameter, a first thickness, and opposing first tube ends. Within premix fuel nozzle 40 is a second tube 44 having a second outer diameter, a second inner diameter, a second thickness, and opposing second tube ends. The second outer diameter of second tube 44 is smaller than the first inner diameter of first tube 43 thereby forming a first annular passage 45 between the first and second tubes, 43 and 44, respectively. Dual fuel premix nozzle 40 further contains a third tube 46 having a third outer diameter, a third inner diameter, a third thickness, and opposing third tube ends. The third outer diameter of third tube 46 is smaller than said second inner diameter of second tube 44, thereby forming a second annular passage 47 between the second and third tubes 44 and 46, respectively. Third tube 46 contains a third passage 57.

Dual fuel premix nozzle 40 further comprises an injector assembly 49, which is fixed to first and second tubes, 43 and 44, respectively, at the tube ends thereof opposite base 41. Injector assembly 49 includes a plurality of radially extending fins 50, each of the fins having an outer surface, an axial length, a radial height, and a circumferential width.

Each of fins 50 are angularly spaced apart by an angle a of at least 30 degrees and fins 50 further include a first radially extending slot 51 within fin 50 and a second radially extending slot 52 within fin 50, a set of first injector holes 53 located in the outer surface of each of fins 50 and in fluid communication with first slot 51 therein. A set of second injector holes, 54 and 54A are located in the outer surface of each of fins 50 and in fluid communication with second slot 52 therein. Fixed to the radially outermost portion of the outer surface of fins 50 to enclose slots 51 and 52 are fin caps 55. Injector assembly 49 is fixed to nozzle 40 such that first slot 51 is in fluid communication with first passage 45 and second slot 52 is in fluid communication with second passage 47. Premix nozzle 40 further includes a fourth tube 80 having a generally conical shape with a tapered outer surface 81, a fourth inner diameter, and opposing fourth tube ends. Fourth tube 80 is fixed at fourth tube ends to injector assembly 49, opposite first tube 43 and second tube 44, and to third tube 46. The fourth inner diameter of fourth tube 80 is greater in diameter than the third outer diameter of third tube 46, thereby forming a fourth annular passage 82, which is in fluid communication with second passage 47.

Nozzle 40 further includes the capability of operating under dual fuel conditions, gas or liquid fuel, through the use of additional concentric tubes. Within third tube 46 is a fifth tube 56 having a fifth outer diameter, a fifth inner diameter, a fifth thickness, and opposing fifth tube ends. The outer diameter of fifth tube 56 is smaller than the inner diameter of third tube 46 such that third passage 57, which is formed between third tube 46 and fifth tube 56, is annular in shape. The fifth tube 56 further includes a means for engagement 60, such as threading, located at the fifth tube end proximate base 41. Located coaxial to and within fifth tube 56 is sixth tube 61. Sixth tube 61 has a sixth outer diameter, a sixth inner diameter, a sixth thickness, and opposing sixth tube ends. The outer diameter of sixth tube 61 is smaller than the inner diameter of fifth diameter 56 thereby forming a fifth annular passage 62. Sixth tube 61 further includes a swirler 63 located on its outer diameter at a sixth tube end, proximate the nozzle tip cap assembly 59, such that a swirl is imparted to the fluid flowing through fifth annular passage 62. A means for engagement 64 is located at an end of sixth tube 61, opposite of swirler 63. Sixth tube 61 also contains a passage 65 contained within its inner diameter. When assembled, fifth tube 56 and sixth tube 61 are each fixed to housing 75, shown in FIG. 7, through the means for engagement 60 and 64, respectively. In order to allow fifth tube 56 and sixth tube 61 to fit within nozzle tip cap assembly 59, the cap assembly, which is fixed to fourth tube 80, has a seventh outer diameter and seventh inner diameter such that the seventh inner diameter has substantially the same inner diameter as that of third tube 46. The use of a conical shaped tube as fourth tube 80 allows a smooth transition in flow path between injector assembly 49 and cap assembly 59 such that large zones of undesirable recirculation, downstream of fins 50, are minimized. If the recirculation zones are not minimized, they can provide an opportunity for fuel and air to mix to the extent that combustion occurs and is sustainable upstream of the desired combustion zone.

The dual fuel premix nozzle 40, in the present embodiment, injects fluids, such as natural gas and compressed air, or liquid fuel, water, and compressed air, depending on the mode of operation, into a combustor of a gas turbine engine for the purposes of establishing a premix pilot flame and supporting combustion downstream of the fuel nozzle. One operating embodiment for this type of fuel nozzle is in a dual stage, dual mode combustor similar to that shown in FIG. 7. A dual stage, dual mode combustor 70 includes a primary combustion chamber 71 and a secondary combustion chamber 72, which is downstream of primary chamber 71 and separated by a venturi 73 of reduced diameter. Combustor 70 further includes an annular array of diffusion type nozzles 74 each containing a first annular swirler 76. In the gas only combustor operation, the dual fuel premix nozzle 40 of the present invention is located along center axis A—A of combustor 70, upstream of second annular swirler 77, and is utilized as a secondary fuel nozzle to provide a pilot flame to secondary combustion chamber 72 and to further support combustion in the secondary chamber. In gas operation, flame is first established in primary combustion chamber 71, which is upstream of secondary combustion chamber 72, by an array of diffusion-type fuel nozzles 74, then a pilot flame is established in secondary combustion chamber 72 when fuel and air are injected from nozzle 40. Gaseous fuel flow is then increased to secondary fuel nozzle 40 to establish a more stable flame in secondary combustion chamber 72, while flame is extinguished in primary combustion chamber 71, by cutting off fuel flow to diffusion-type nozzles 74. Once a stable flame is established in secondary combustion chamber 72 and flame is extinguished in primary combustion chamber 71, fuel flow is restored to diffusion-type nozzles 74 and fuel flow is reduced to secondary fuel nozzle 40 such that primary combustion chamber 71 now serves as a premix chamber for fuel and air prior to entering secondary combustion chamber 72. The present invention, as operated on gas fuel, will now be described in detail with reference to the particular operating environment described above.

In the preferred embodiment, nozzle 40 operates in a dual stage dual mode combustor 70, where nozzle 40 serves as a secondary fuel nozzle. The purpose of the nozzle is to provide a source of flame for secondary combustion chamber 72 and to assist in transferring the flame from primary combustion chamber 71 to secondary combustion chamber 72. In this role, the second passage 47, second slot 52, and second set of injector holes 54 and 54A flow a fuel, such as natural gas into plenum 78 where it is mixed with compressed air prior to combusting in secondary combustion chamber 72. During engine start-up, first passage 45, first slot 51, and first set of injector holes 53 flow compressed air into the combustor to mix with the gaseous fuel. In an effort to maintain machine load condition when the flame from primary combustion chamber 71 is transferred to secondary combustion chamber 72, first passage 45, first slot 51, and first set of injector holes 53 flow fuel, such as natural gas, instead of air, to provide increased fuel flow to the established flame of secondary combustion chamber 72. Once the flame is extinguished in primary combustion chamber 71 and securely established in secondary combustion chamber 72, fuel flow through the first passage 45, first slot 51, and first set of injector holes 53 of premix nozzle 40 is slowly cut-off and replaced by compressed air, as during engine start-up.

Figure 3:
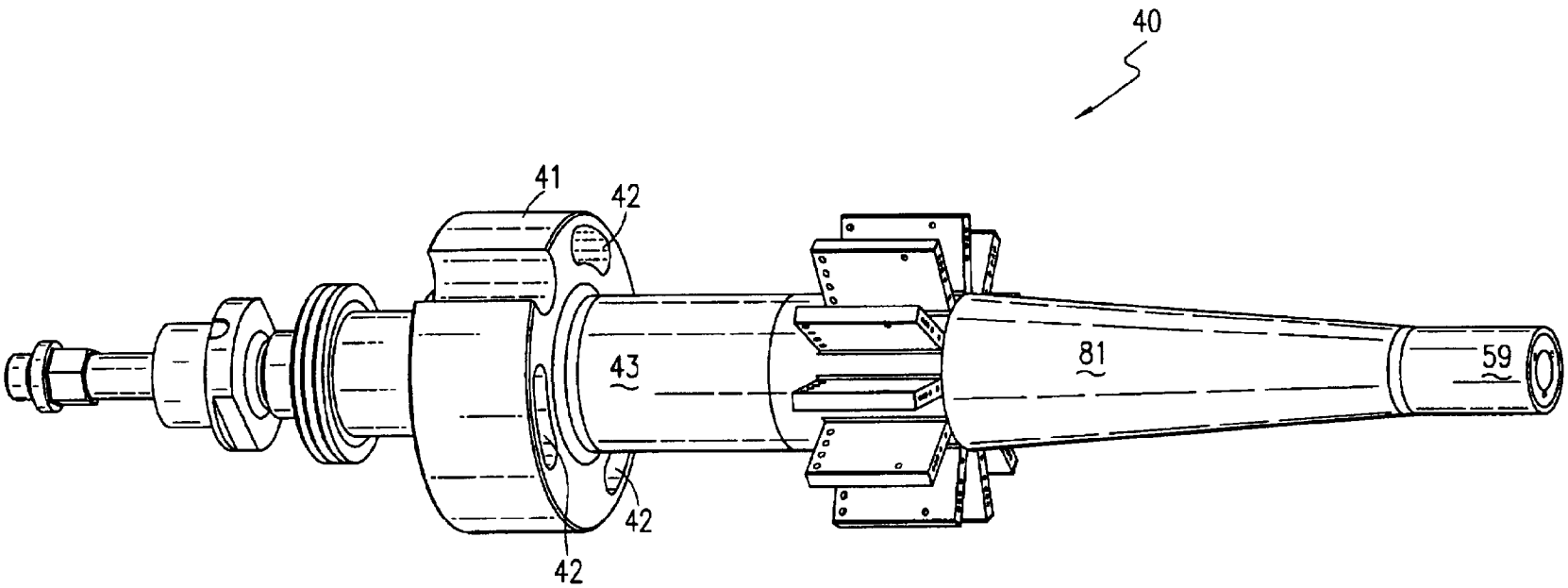
FIG. 3 is a perspective view of the present invention.
Figure 4:
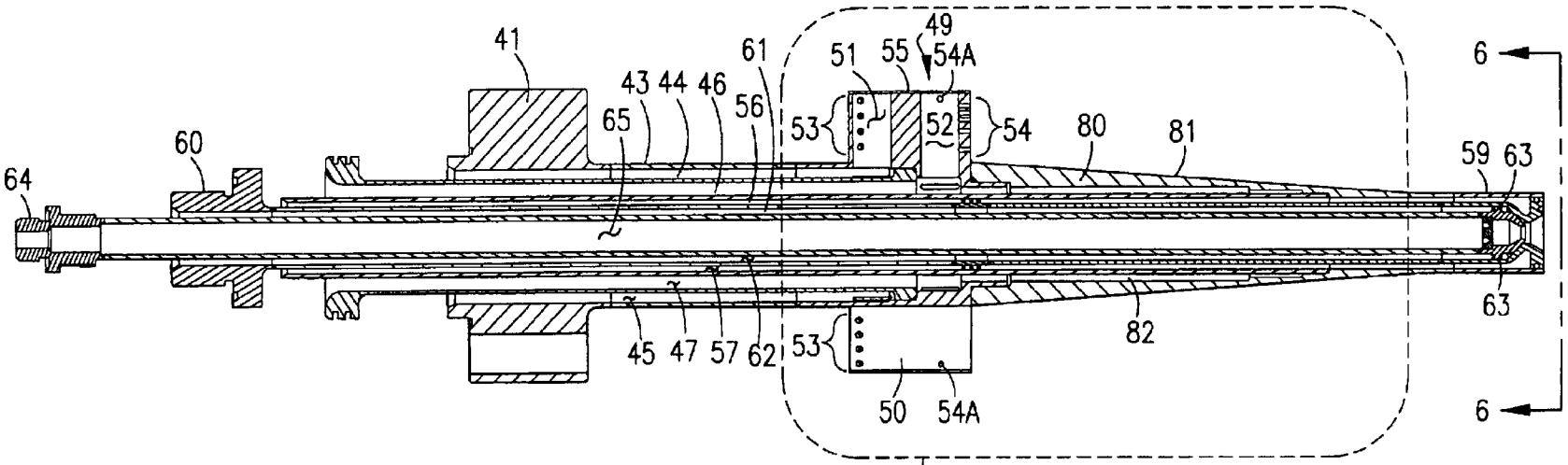
FIG. 4 is a cross section view of the present invention.
Figure 5:
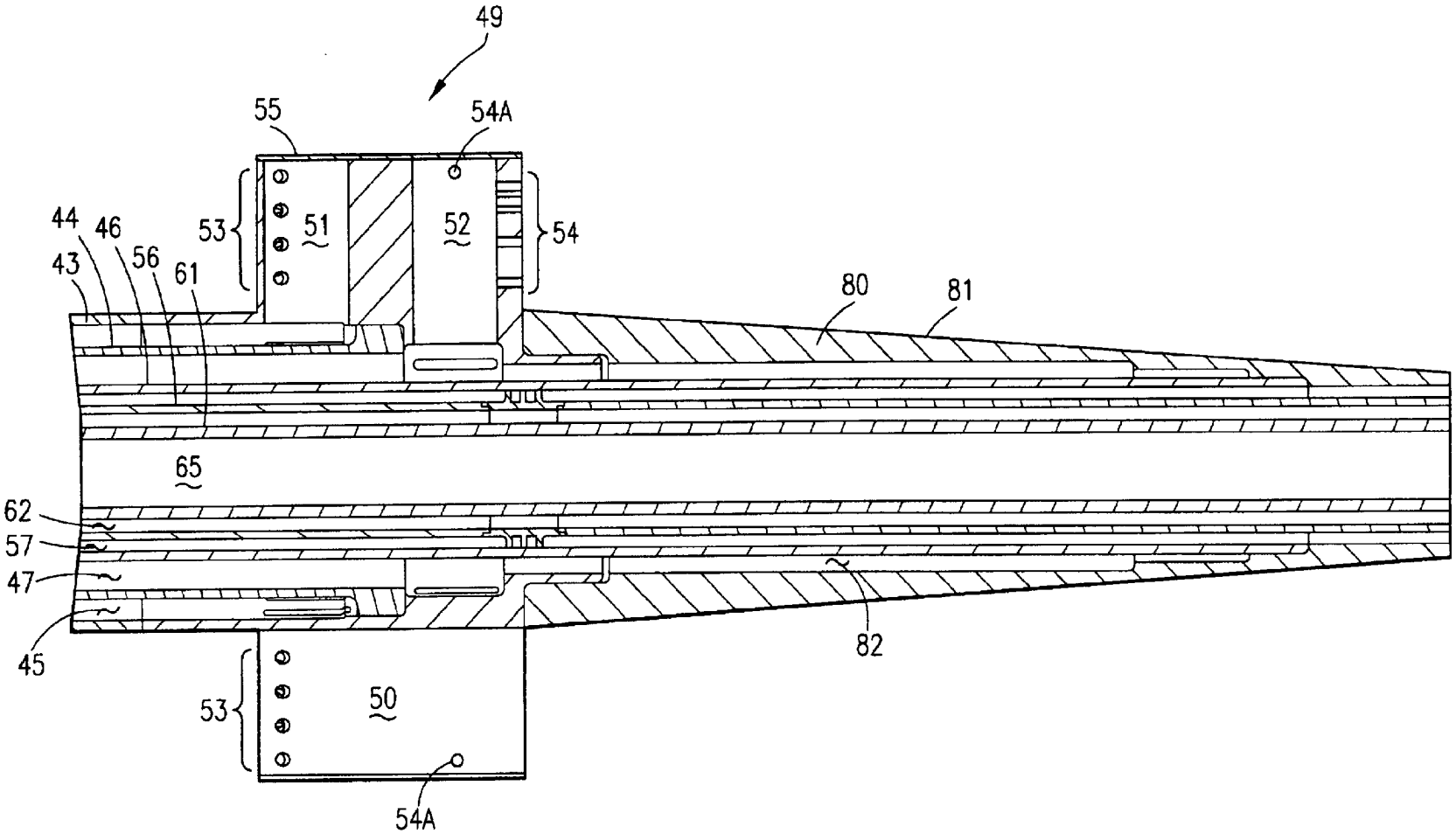
FIG. 5 is a detail view in cross section of the injector assembly of the present invention.
Figure 6:
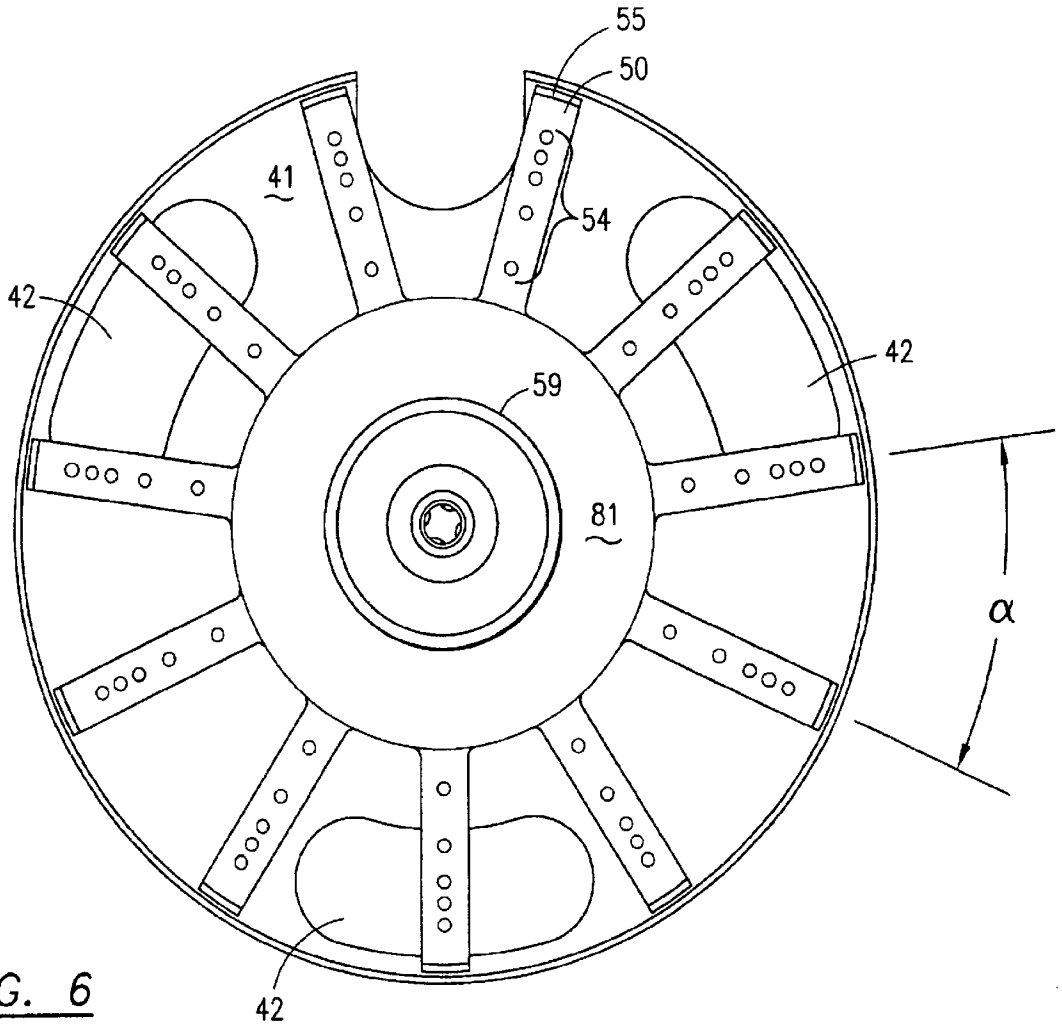
FIG. 6 is an end elevation view of the nozzle tip of the present invention.

NOx emissions are reduced through the use of this premix nozzle by ensuring that all fuel that is injected is thoroughly mixed with compressed air prior to reaching the flame front of the combustion zone. This is accomplished by the use of the fin assembly 49 and through proper sizing and positioning of injector holes 53, 54, and 54A. Thorough analysis has been completed regarding the sizing and positioning of the first and second set of injector holes, such that the injector holes provide a uniform fuel distribution. To accomplish this task, first set of injector holes 53, having a diameter of at least 0.050 inches, are located in a radially extending pattern along the outer surfaces of fins 50 as shown in FIG. 3. To facilitate manufacturing, first set of injector holes 53 have an injection angle relative to the fin outer surface such that fluids are injected upstream towards base 41. Second set of injector holes, including holes 54 on the forward face of fins 50 and 54A on outer surfaces of fin 50, proximate fin cap 55, are each at least 0.050 inches in diameter. Injector holes 54A are generally perpendicular to injector holes 54, and have a slightly larger flow area than injector holes 54. Second set of injector holes 54 and 54A are placed at strategic radial locations on fins 50 so as to obtain an ideal degree of mixing which both reduces emissions and provides a stable shear layer flame in secondary combustion chamber 72. To further provide a uniform fuel injection pattern and to enhance the fuel and air mixing characteristics of the premix nozzle, all fuel injectors are located upstream of second annular swirler 77.

Figure 7:
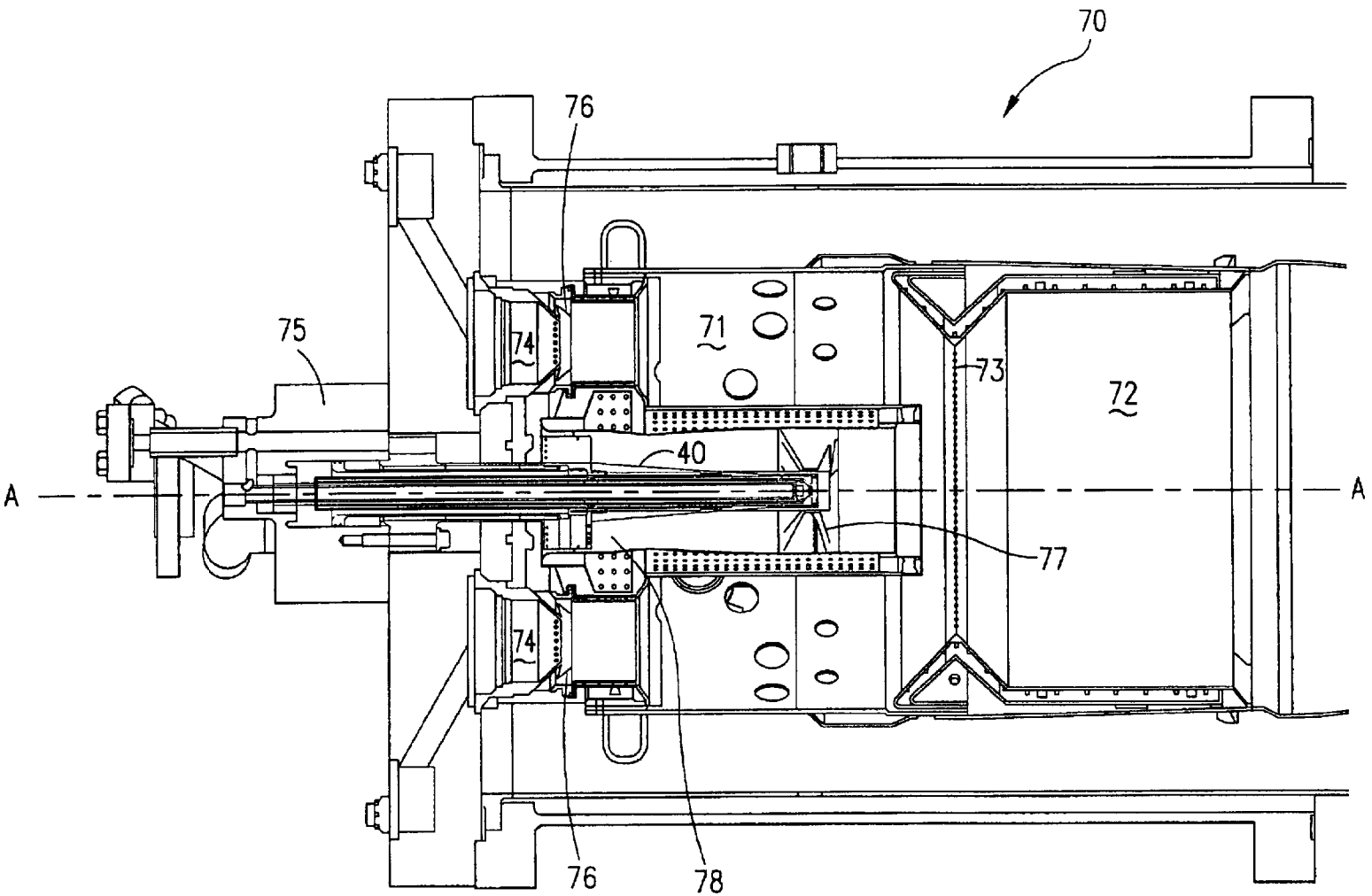
FIG. 7 is a cross section view of the present invention installed in a combustion chamber.

Dual fuel premix nozzle 40 can operate on either gaseous fuel or liquid fuel, and can alternate between the fuels as required. Depending on gas fuel cost, gas availability, scheduled operating time, and emissions regulations, it may advantageous to operate on liquid fuel. When dual fuel premix nozzle 40 is operating in a liquid mode in a dual stage dual mode combustor, the annular array of diffusion type nozzles 74 of FIG. 7 are also operating on liquid fuel. Both the diffusion type nozzle 74 and dual fuel premix nozzle 40 alternate between liquid and gas fuels together. In the preferred embodiment of a dual stage dual mode combustor, when operating on liquid fuel, the start-up sequence to the combustor is similar to that of the gas fuel operation, but when increasing in load to full power, fuel nozzle operating conditions are slightly different. Liquid fuel is first flowed to the diffusion type nozzles 74 and a flame is established in primary combustion chamber 71. Liquid flow is then decreased to diffusion nozzles 74 while it is directed to the dual fuel premix nozzle 40 to establish a flame in secondary combustion chamber 72. The fuel flow is maintained in both the diffusion nozzles 74 and dual fuel premix nozzle 40 as the engine power increases to full base load condition, with flame in both the primary and secondary combustion chambers, 71 and 72, respectively. At approximately 50% load condition, water can be injected into the combustion chambers, by way of the fuel nozzles, to lower the flame temperature, which in turn reduces NOx emissions.

With specific reference to the nozzle embodiment disclosed in FIGS. 3–6 in the liquid fuel operating condition, liquid fuel passes through passage 65 of sixth tube 61 and injects fuel into secondary combustion chamber 72. Mixing with the liquid fuel in secondary combustion chamber 72, at load conditions above 50%, is a spray of water that is also injected by nozzle 40. Water flows coaxial to sixth tube 61 through fifth tube 56 via fifth annular passage 62, and exits nozzle 40 in a swirling pattern imparted by swirler 63, which is positioned in fifth annular passage 62. Passages 45 and 47, slots 51 and 52, and first and second sets of injector holes 53, 54, and 54A, which flowed either natural gas or compressed air in the gas mode operation each flow compressed air in liquid operation to purge the nozzle passages such that liquid fuel does not recirculate into the gas or air passages.

Figure 8:
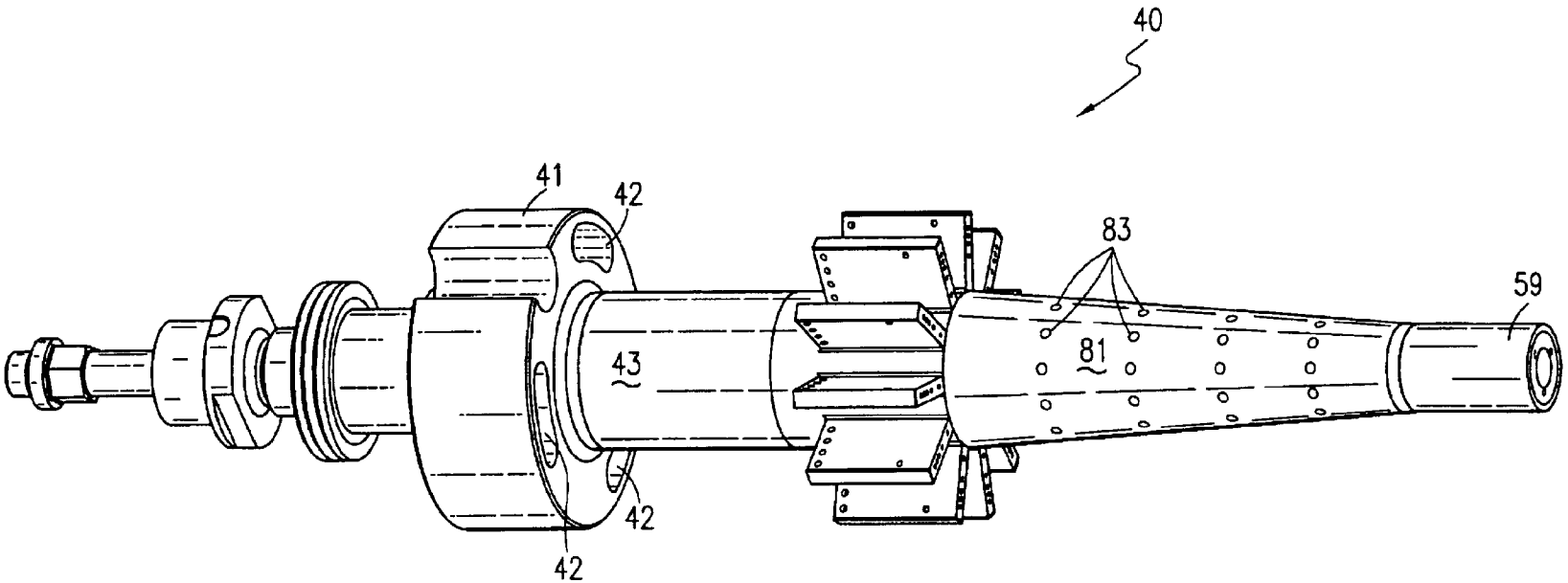
FIG. 8 is a perspective view of an alternate embodiment of the present invention.
Figure 9:
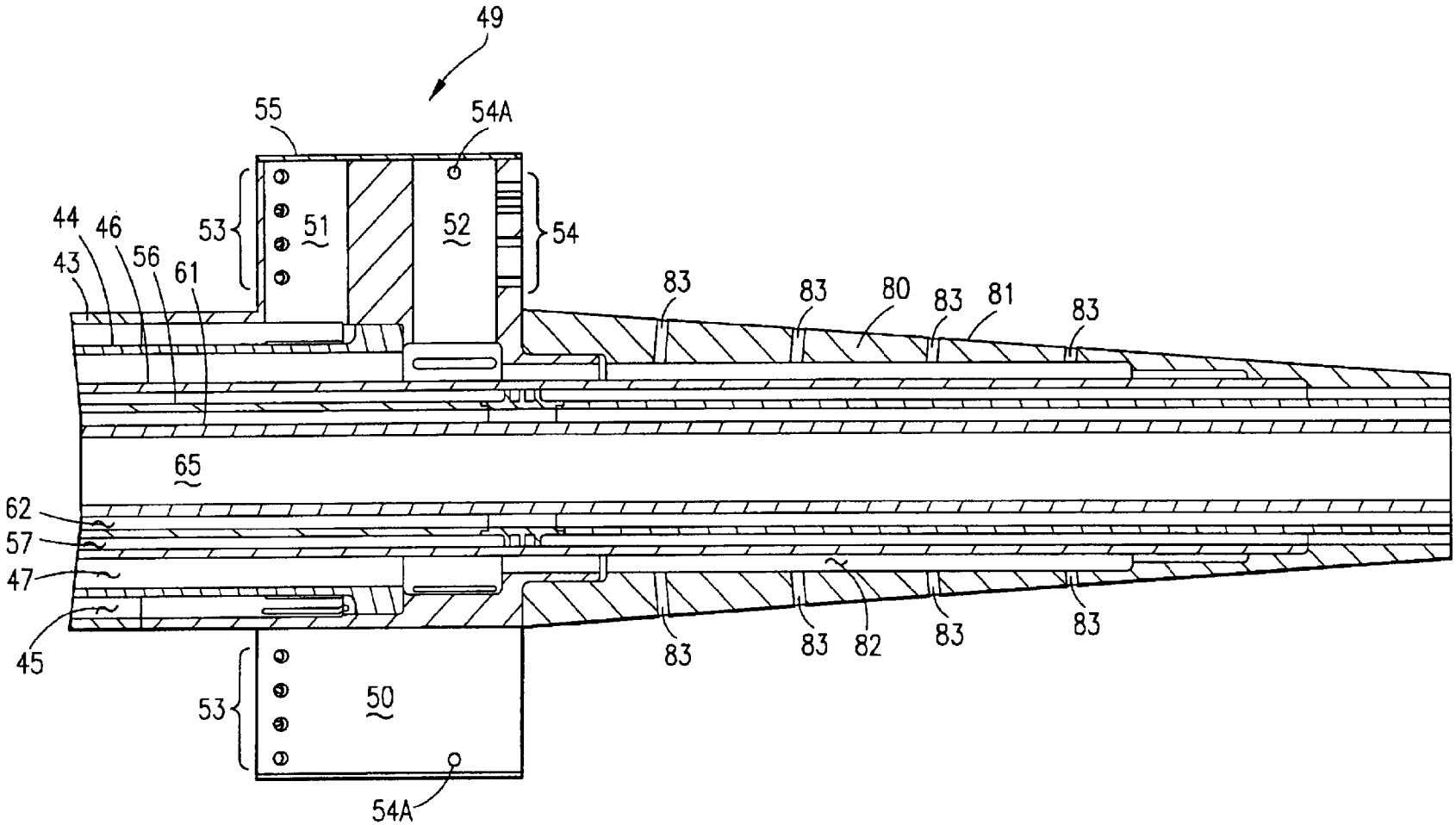
FIG. 9 is a detail view in cross section of an alternate embodiment of the injector assembly of the present invention.

An alternate embodiment of the present invention is shown in FIGS. 8 and 9. The alternate embodiment includes all of the elements of the preferred embodiment as well as a fourth set of injector holes 83, which are in communication with fourth annular passage 82 of fourth tube 80. These injector holes provide an additional source of gas fuel for combustion. The additional gas fuel from fourth set of injector holes 83 premixes with fuel and air, from injector assembly 49, in passage 78 (see FIG. 7) to provide a more stable flame, through a more fuel rich premixture, in the shear layer of the downstream flame zone region 90. Fourth set of injector holes 83 are placed about the conical surface 81 of fourth tube 80, between injector assembly 49 and cap assembly 59, and have a diameter of at least 0.025 inches.

Figure 10:
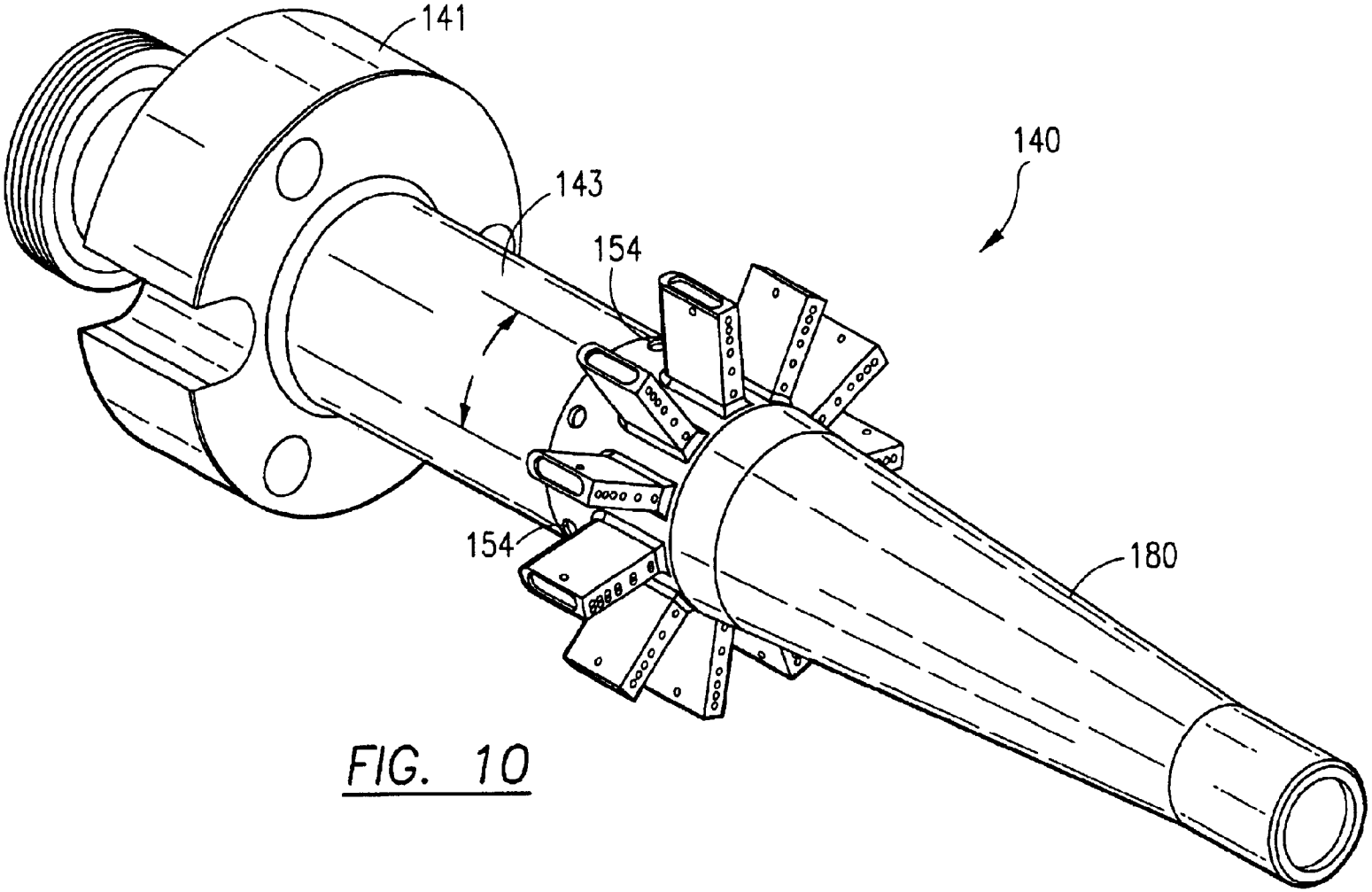
FIG. 10 is a perspective view of a second alternate embodiment of the present invention.
Figure 11:
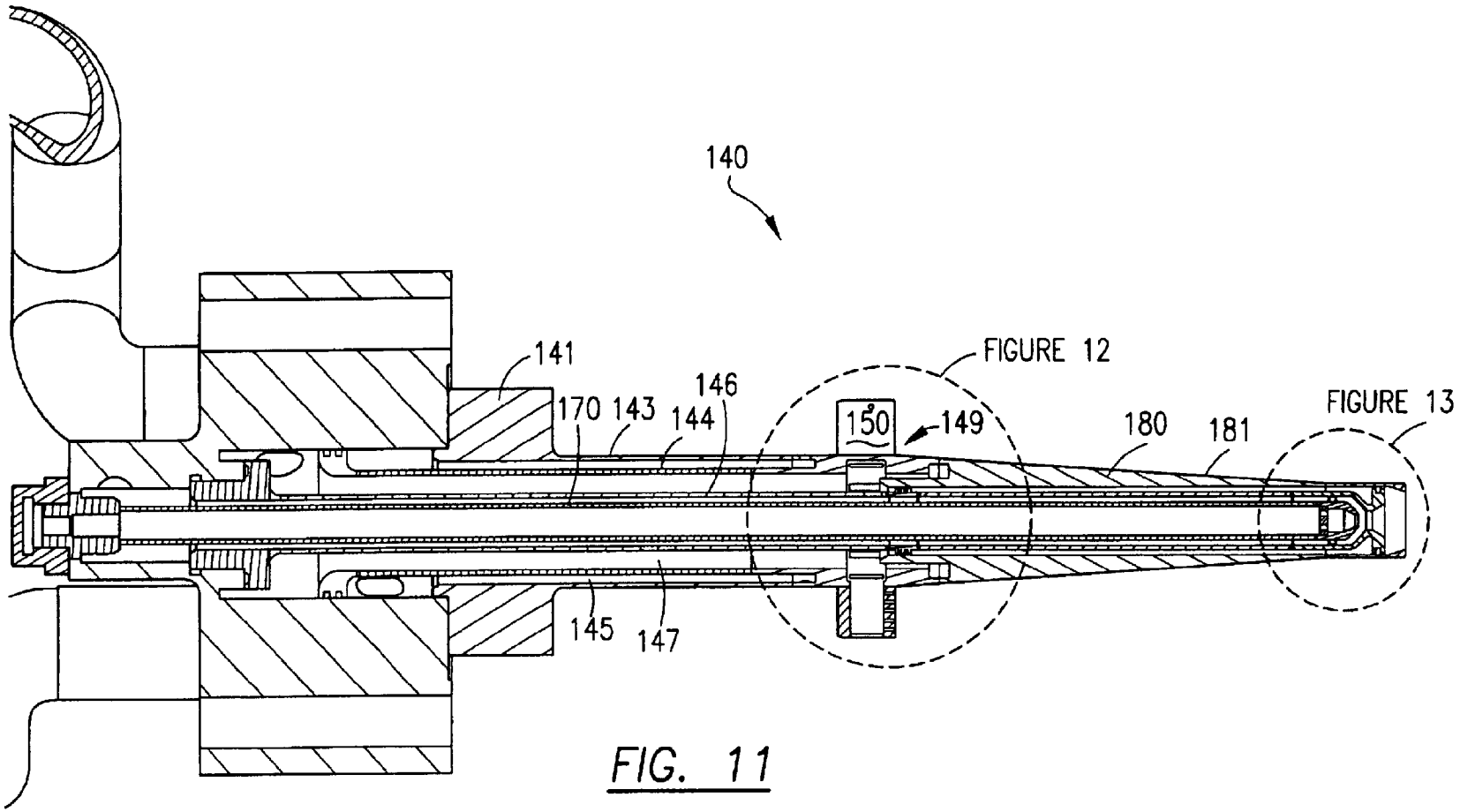
FIG. 11 is a cross section view of a second alternate embodiment of the present invention.
Figure 12:
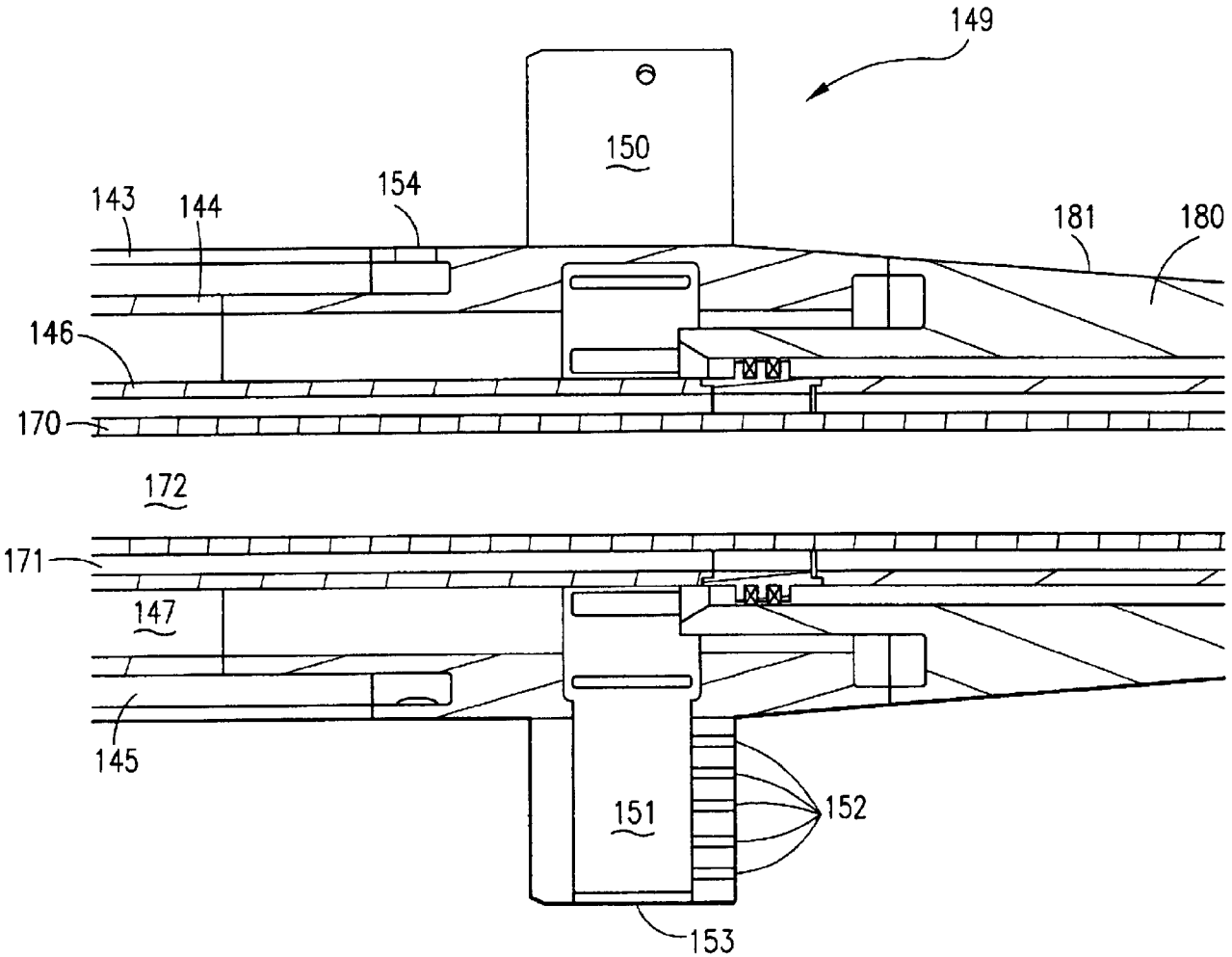
FIG. 12 is a detail view in cross section of the injector assembly in accordance with the second alternate embodiment of the present invention.

A second alternate embodiment of the present invention is shown in FIGS. 10–13. A fuel nozzle 140 capable of dual fuel operation has a base 141 with three through holes for bolting fuel nozzle 140 to a housing. Referring to FIGS. 11 and 12, a first tube 143 extends from base 141 having a first outer diameter, a first inner diameter, and opposing first tube ends. Within fuel nozzle 140 and coaxial with first tube 143 is a second tube 144 having a second outer diameter, a second inner diameter, and opposing second tube ends. The second outer diameter of second tube 144 is smaller than the first inner diameter of first tube 143 thereby forming a first annular passage 145 between the first and second tubes, 143 and 144, respectively. Fuel nozzle 140 further contains a third tube 146 having a third outer diameter, a third inner diameter, and opposing third tube ends. The third outer diameter of third tube 146 is smaller than said second inner diameter of second tube 144, thereby forming a second annular passage 147 between second and third tubes, 144 and 146, respectively.

Referring to FIG. 12, fuel nozzle 140 further comprises an injector assembly 149, which is fixed to both first and second tubes, 143 and 144, respectively, at the tube ends thereof opposite base 141. Injector assembly 149 includes a plurality of radially extending fins 150, each of the fins having an outer surface, an axial length, a radial height, and a circumferential width. Fins 150 are angularly spaced apart by an angle a of at least 30 degrees and further include a radially extending slot 151 that is in fluid communication with second annular passage 147. Located in the outer surface of each fin 150 is a set of first injector holes 152 that are in fluid communication with radially extending slots 151 and preferably have a diameter of at least 0.040 inches. Fixed to the radially outermost portion of the outer surface of fins 150, to enclose slots 151, are fin caps 153. Injector assembly 149 also includes a set of second injector holes 154 that are in fluid communication with first passage 145, located upstream of and circumferentially offset from fins 150. Second injector holes preferably have a diameter of at least 0.150 inches.

Referring to FIGS. 10–12, nozzle 140 further includes a fourth tube 180 having a generally conical shape with a tapered outer surface 181, a fourth inner diameter, and opposing fourth tube ends. Fourth tube 180 is fixed at a fourth tube end to injector assembly 149, opposite first tube 143 and second tube 144, and is in sealing contact with third tube 146 at the fourth tube inner diameter.

Nozzle 140 also includes a fifth tube 170 having a fifth outer diameter, a fifth inner diameter, opposing fifth tube ends, where fifth tube 170 is located within third tube 146 such that the fifth outer diameter is smaller than the third inner diameter, thereby forming a third annular passage 171 between the third tube and the fifth tube. Fifth tube 170 has a means for engagement at a fifth tube end and contains a fourth annular passage 172 within the fifth inner diameter.

Figure 13:
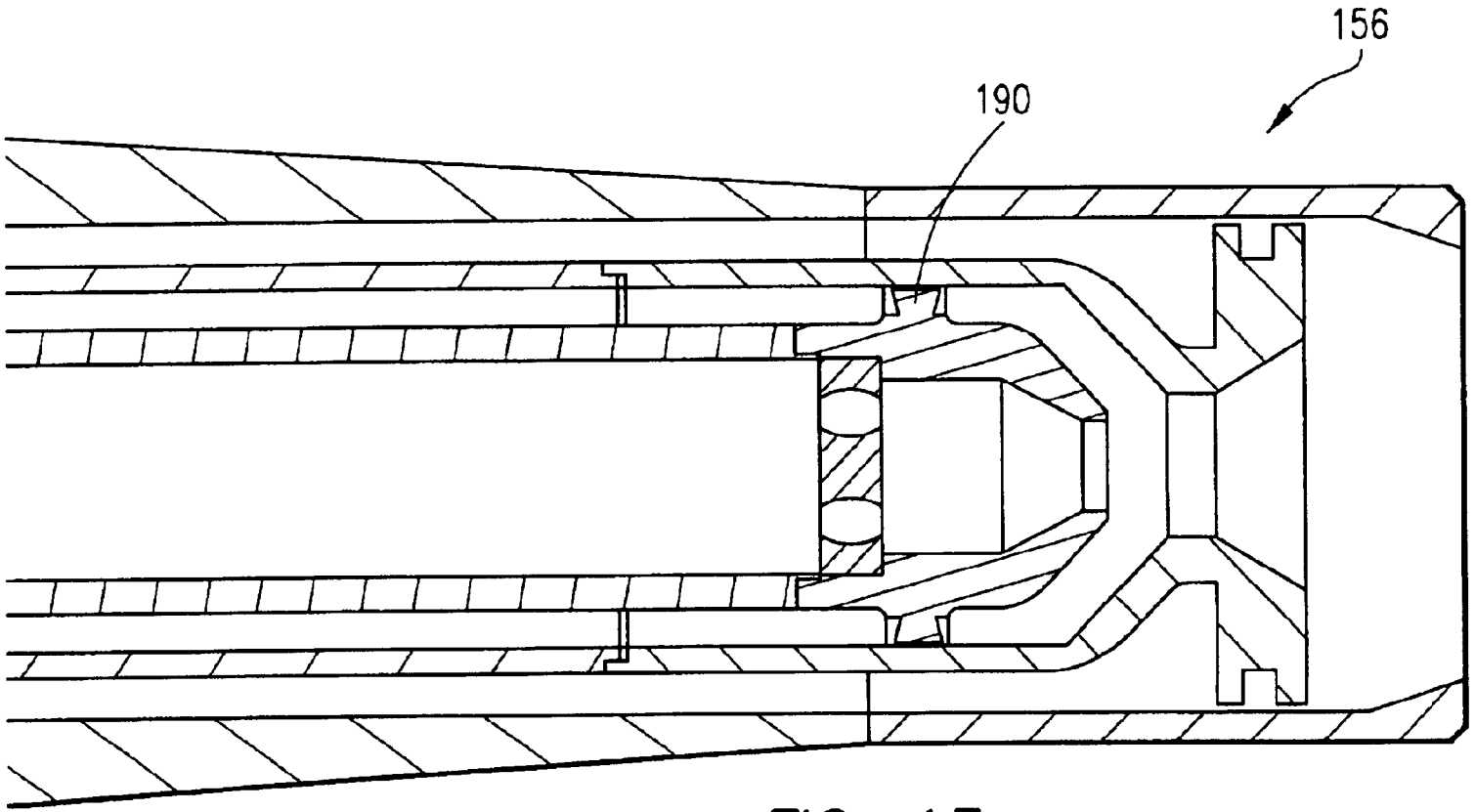
FIG. 13 is a detail view in cross section of the nozzle tip in accordance with the second alternate embodiment of the present invention.

Referring now to FIG. 13, fixed to a fourth tube end opposite injector assembly 149 is a cap assembly 156 having a sixth outer diameter and a sixth inner diameter with the sixth inner diameter substantially the same as the fourth inner diameter. Third tube 146 and fifth tube 170 extend from upstream of base 141 to proximate cap assembly 156.

The second alternate embodiment of the present invention, nozzle 140, preferably operates in a dual stage dual mode combustor. The purpose of the nozzle is to provide a flame source for a secondary combustion chamber and to assist in transferring a flame from a primary combustion chamber to a secondary combustion chamber. This type of combustion system can utilize different fuels such as gas or a liquid fuel such as oil. The fuel selection will determine which circuits of nozzle 140 are flowing fuel or compressed air to purge the nozzle.

When the present invention is being operated on natural gas, compressed air initially flows through first passage 145 and is injected into the surrounding airstream through second injector holes 154 while gas flows through second passage 147, slots 151, and is injected into the surrounding airstream through first injector holes 152. Then, in an effort to maintain machine load while transferring the flame from the primary combustion chamber to the secondary combustion chamber, first passage 145 and second injector holes 154 flow a fuel, such as natural gas, instead of air, to provide an enriched fuel flow to the secondary combustion chamber. Once the flame is extinguished in the primary combustion chamber and securely established in secondary combustion chamber, fuel flow through first passage 145 and second set of injector holes 154 of nozzle 140 is slowly cut-off and replaced with compressed air, as during initial operation. During this entire operation, compressed air flows through third passage 171 and fourth passage 172 to ensure that no fuel particles recirculate into the premix nozzle 140.

When conditions are present that require nozzle 140 to be operated on liquid fuel, a liquid fuel such as oil passes through fourth passage 172 of fifth tube 170 and injects fuel into the secondary combustion chamber. Mixing with the liquid fuel in the secondary combustion chamber, at load conditions above 50%, is a spray of water that is also injected by nozzle 140. Water flows coaxial to fifth tube 170 through third tube 146 via third annular passage 171, and exits nozzle 140 in a swirling pattern imparted by swirler 190, which is positioned in third annular passage 171. First annular passage 145, second annular passage 147, slots 151, and first and second sets of injector holes 152 and 154, which flowed either natural gas or compressed air in the gas mode operation each flow compressed air during liquid operation to purge the nozzle passages such that liquid fuel does not recirculate into the gas or air passages.

Prior embodiments of the present invention included second injector holes in the fins of the injector assembly. It has been determined through extensive analysis that the flow exiting from the second injector holes, when placed in the fins, penetrates far enough into the main flow of compressed air passing between the fins to block part of the compressed air from flowing in between the fins. As a result, less compressed air mixes with the fuel injected from first injector holes thereby resulting in increased fuel/air ratio, especially when second injector holes are flowing fuel. While an increased fuel supply provides a more stable flame, emissions tend to be higher. Analysis results indicate that this blockage is on the order of approximately 10% of the total flow area. Further compounding the blockage issue in the previous embodiments is the flow disturbance created by sharp corners along the upstream side of fins 50. In the second alternate embodiment, fins 150 have rounded edges along the upstream side, creating a smoother flow path along the fin outer surfaces. By placing second injector holes 154 in injector assembly 149 adjacent first outer tube 143, thereby eliminating a portion of the fins, the overall geometry of injector assembly 149 is simplified. Each of the improvements outlined herein leads to improved fuel nozzle performance by reducing the amount of flow blockage between adjacent fins while simplifying the configuration for manufacturing purposes.

While the invention has been described in what is known as presently the preferred embodiment, it is to be understood that one skilled in the art of combustion and gas turbine technology would recognize that the invention is not to be limited to the disclosed embodiment but, on the contrary, is intended to cover various modifications and equivalent arrangements within the scope of the following claims.

What we claim is:

1. A fuel nozzle assembly capable of dual fuel operation for use in a gas turbine comprising:

a base;

a first tube having a first outer diameter, a first inner diameter, and opposing first tube ends, said base fixed to said first tube at one of said ends;

a second tube coaxial with said first tube and having a second outer diameter, a second inner diameter, and opposing second tube ends, said second outer diameter smaller than said first inner diameter thereby forming a first annular passage between said first and second tubes;

a third tube coaxial with said second tube and having a third outer diameter, a third inner diameter, and opposing third tube ends, said third outer diameter smaller than said second inner diameter thereby forming a second annular passage between said second and third tubes;

an injector assembly fixed to each of said first and second tubes at said tube ends thereof opposite said base, said injector assembly having a plurality of radially extending fins, each of said fins having an outer surface, an axial length, a radial height, and a circumferential width, a radially extending slot within said fin, a set of first injector holes located in said outer surface of each of said fins and in fluid communication with said slot therein, a set of second injector holes located in said injector assembly such that said second injector holes are in fluid communication with said first passage and located between said base and said fins;

a fourth tube coaxial with said third tube and having a generally conical shape with a tapered outer surface and a fourth inner diameter, said fourth tube having opposing fourth tube ends, one of said fourth tube ends fixed to said injector assembly opposite said first and second tubes, and said fourth tube in sealing contact with said third tube at said fourth inner diameter;

a fifth tube having a fifth outer diameter, a fifth inner diameter, and opposing fifth tube ends, said fifth tube having a means for engagement at one of said fifth tube ends, said fifth outer diameter smaller than said third inner diameter thereby forming a third annular passage between said third and fifth tubes, said fifth tube having a fourth annular passage contained within said fifth inner diameter;

a cap assembly fixed to said fourth tube and having a sixth outer diameter and a sixth inner diameter, wherein said sixth inner diameter is substantially the same as said fourth inner diameter; and, wherein each of said slots is in fluid communication with said second passage.

2. The fuel nozzle of claim 1 wherein said first passage and each of said second injector holes flow natural gas or compressor air into a combustor, depending on combustor mode of operation.

3. The fuel nozzle of claim 1 wherein said second passage, each of said slots, and said first injector holes flow natural gas into a combustor.

4. The fuel nozzle of claim 1 where in said third passage flows water into the combustor.

5. The fuel nozzle of claim 1 where in said fourth passage flows liquid fuel into the combustor.

6. The fuel nozzle of claim 1 wherein each of said first injector holes is at least 0.040 inches in diameter.

7. The fuel nozzle of claim 1 wherein each of said second injector holes is at least 0.150 inches in diameter.

8. The fuel nozzle of claim 1 wherein said set of second injector holes are offset circumferentially from said fins of said injector assembly.

9. The fuel nozzle of claim 1 wherein said fins are spaced apart circumferentially by an angle a of at least 30 degrees.

* * * * *